US005126107A

United States Patent [19]

Darnfors

[11] Patent Number: 5,126,107

[45] Date of Patent: Jun. 30, 1992

[54] IRON-, NICKEL-, CHROMIUM BASE ALLOY

[75] Inventor: Sven Darnfors, Västerås, Sweden

[73] Assignee: Avesta Aktiebolag, Avesta, Sweden

[21] Appl. No.: 671,841

[22] PCT Filed: Nov. 7, 1989

[86] PCT No.: PCT/SE89/00630

§ 371 Date: Apr. 10, 1991

§ 102(e) Date: Apr. 10, 1991

[87] PCT Pub. No.: WO90/05792

PCT Pub. Date: May 31, 1990

[30] Foreign Application Priority Data

Nov. 18, 1988 [SE] Sweden ..... 8804178

[51] Int. Cl.[5] ..... C22C 38/48

[52] U.S. Cl. ..... 420/584.1; 420/443; 420/452

[58] Field of Search ..... 420/443, 452, 584

[56] References Cited

U.S. PATENT DOCUMENTS

| | | | |
|---|---|---|---|
| 3,758,294 | 9/1973 | Bellot et al. | 420/584.1 |
| 3,833,358 | 9/1974 | Bellot et al. | 420/584.1 |
| 3,989,514 | 1/1976 | Fujioka et al. | 75/124 |
| 4,224,062 | 9/1980 | Darnfors | 420/584.1 |
| 4,448,749 | 5/1984 | Sugitani et al. | 420/584 |
| 4,530,720 | 7/1985 | Moroishi et al. | 75/128 A |

FOREIGN PATENT DOCUMENTS 3527663 2/1986 Fed. Rep. of Germany .

*Primary Examiner*—R. Dean
*Assistant Examiner*—Sikyin Ip
*Attorney, Agent, or Firm*—Nixon & Vanderhye

[57] ABSTRACT

An iron, nickel-, chromium base alloy having an austenitic structure, good high temperature features, including a very high resistance to oxidization in an oxidizing atmosphere and to carburization in a carborizing atmosphere at high temperatures, and a high creep fracture resistance. The alloy has the following composition in weight percent: 0.01–0.08 carbon, 1.2–2.0 silicon, from traces up to 2 manganese, 22–29 chromium, 32–38 nickel, 0.01–0.15 rare earth metals, 0.08–0.25 nitrogen, with the balance essentially of only iron and unavoidable impurities and normally occurring accessory elements in normal amounts. The rare earth metals in combination with the silicon content serve to improve the growth of a protecting silicon dioxide-layer on the metal surface, when the metal surface is subjected to high temperatures in oxidizing atmospheres. This counteracts the transportation of metal irons, in particular chromium, out of the alloy so that scaling is minimized.

12 Claims, 2 Drawing Sheets

IRON-, NICKEL-, CHROMIUM BASE ALLOY

TECHNICAL FIELD

The present invention relates to an iron-, nickel-, chromium base alloy having an austenitic structure and good high temperature features, including a very high resistance against oxidization in oxidizing atmosphere and against carburizing in carburizing atmosphere at high temperatures, as well as a high creep fracture resistance.

BACKGROUND OF THE INVENTION

High alloyed, stainless, austenitic steels or nickel base alloys containing up to 60% nickel conventionally have been used for objects which during a long period of time are subjected to high temperatures in combination with mechanical loading in oxidizing environments. These alloys usually have a high oxidization resistance and often also a very high creep fracture resistance, but because of the increasingly high demands which are raised upon materials for the present field of use there has arisen a need of materials having still better oxidization resistance in oxidizing environments in combination with very good creep fracture resistance, a combination of features which has not satisfactorily been achieved with presently known alloys.

Another problem with known alloys of the above mentioned kind is that they have a comparatively great tendency to take up carbon and nitrogen when exposed in carburizing atmosphere or in environments which involve a risk for the taking up of nitrogen at high temperatures. This particularily concerns austenitic steels but to an essential degree also nickel base alloys. Also attacks from gaseous halides and metal oxides in certain environments may involve problems.

The above mentioned problems will be particularily accentuated in those cases when the material is subjected alternatingly to carburizing and to oxidizing media at high temperatures, or, which sometimes even may occur, in environments which at the same time may act oxidizing as well as carburizing. Those situations when the material in hot condition is exposed to ambient air after having been subjected to carburizing in an furnace at a high temperature are examples of alternatingly carburizing and oxidizing exposures. Similar conditions may occur in furnaces where it from some reason is difficult to maintain a balanced atmosphere. Further may be mentioned furnace linings which are subjected to coke depositions. It is conventional to remove such depositions by burning them off, wherein air is supplied for the combustion, which is a further example of exposure to alternatingly carburizing and oxidizing media. Finally, treatment of poorly degreased goods in oxidizing atmosphere at high temperatures is an example of a situation where carburizing and oxidizing may occur at the same time.

DESCRIPTION OF THE INVENTION

The invention aims at providing an alloy having a composition which brings about an improved resistance at high temperatures against carburizing as well as against oxidizing, and which also gives a good creep fracture resistance. The material according to the invention also has a good resistance to the taking up of nitrogen and also has good resistance to attack from gaseous halides and metal oxides. It can advantageously be used in the form of sheets, plates, bars, rods, wires and tubes in various kinds of furnaces, as for example carburizing furnaces, sintering-, annealing-, and tempering stoves, where also non degreased goods are heat-treated, and it can also be used for accessories for furnaces and stoves, for example charging-baskets, -grates and -buckets. Further it can be used in burners, combustion chambers, radiant-tubes, reaction rooms in the petrochemical industry and in fluidized beds, exhaust gas filters for motor cars, etc.

The following table shows the broad range for the elements which are included in the alloy according to the invention, and also the preferred, and the suitably chosen ranges. The contents are expressed in weight-%. The balance is iron, unavoidable impurities in normal amounts and normally existing accessory elements. For example there is a negligible amount of aluminum and calcium in the steel as a rest due from the finishing metallurgical operation prior to casting. The contents of phosphorus and sulphur are very small, max 0.04%, and max 0.008%, respectively.

TABLE 1

| | Broad ranges | Preferably chosen ranges | Preferred composition |
|---|---|---|---|
| C | 0.01–0.08 | 0.02–0.08 | 0.035–0.065 |
| Si | 1.2–2.0 | 1.3–1.8 | 1.3–1.8 |
| Mn | from traces to max 2 | | 1.3–1.8 |
| Cr | 22–29 | 23–27 | 24–26 |
| Ni | 32–38 | 33–37 | 34–36 |
| Rare earth metals | 0.01–0.15 | 0.02–0.12 | 0.03–0.10 |
| N | 0.08–0.25 | 0.1–0.2 | 0.12–0.18 |

The carbon content has importance for the features of the steel, as far as the strength is concerned, and shall therefore exist in an amount of at least 0.01%, preferably at least in an amount of 0.02%, and suitably not less than 0.035%. If the alloy shall be used for the production of plates, sheets, rods, wires, and/or tubes, the carbon content, however, should not exceed 0.08%, suitably not exceed 0.065%.

Silicon is required in an amount of at least 1.2% in order that a combination effect between silicon and the rare earth metals shall be achieved with reference to the oxidization resistance. This will be explained more in detail in connection with the description of the cerium content. Silicon also is favourable for the carburizing resistance. From these reasons, the silicon content should be at least 1.3%. The upper silicon limit, 2.0%, preferably max 1.8%, is due to circumstances which has to do with technical circumstances relating to the manufactoring and also to the fact that higher silicon contents may cause difficultes in connection with welding.

Manganese generally improves the strength but impaires the oxidization resistance. The content of manganese therefore should not exceed 2% and should suitably be 1.3–1.8%.

Phosphorous and sulphur in amounts exceeding the above mentioned maximum limits have an unfavourable influence upon the hot workability.

The chromium content is high and lies within the range 22–29%, preferably 23–27%. Herethrough there is achieved, in combination with a high nickel content, a high silicon content, and a significant content of rare earth metals, a good resistance against high temperature damages, in the first place against carburizing and oxidization at high temperatures.

Nickel is favourable for the oxidaization resistance and also for the carburization resistance and shall exist in an amount between 32 and 38%, preferably in an amount between 33 and 37%. A preferred composition is 34-36%.

Rare earth metal in the form of the lanthanum group of metals in an amount, expressed in the amount of cerium which normally stands for about 50% of the mischmetal, of 0.01-0.15%, preferably at least 0.02%, and suitably at least 0.03% cerium, improves the formation of a thin, elastic and adhering oxide film, when the alloy according to the invention is exposed to an oxidizing environment at high temperatures. However, there is not obtained any further improvement of the oxidization resistance in proportion to the addition of rare earth metals, if the content of rare earth metals, in the first place cerium, exceeds 0.12%. The preferred range for the amount of rare earth metal therefore lies between 0.03 and 0.10%. Possibly the rare earth metals completely or partly may be replaced by earth alkali metals.

Cerium and other lanthanides (rare earth metals) are suitably supplied as mischmetal to the finished molten alloy together with silicon-calcium or possibly lime as a final operation. Through the addition of silicon calcium and/or by covering the melt with a layer of lime it is possible to prevent major losses of cerium and other rare earth metals, so that the rare earth metals, as expressed in amount of cerium, will exist in a sufficient amount in the finished product in order to bring about the desired effect. Through the influence of cerium and other rare earth metals in the mentioned range of composition there will in combination with silicon in the above mentioned range of composition be achieved a favourable impact upon the growth of a $SiO_2$-layer on the metal surface, when the metal surface is subjected to high temperatures in an oxidizing environment. This $SiO_2$-layer will form a barrier against the transportation of metal ions, in the first place chromium, out of the alloy, so that scaling is minimized.

Nitrogen has a favourable influence upon the creep fracture strength of the alloy and shall therefore exist in an amount of at least 0.08%, preferably at least 0.1%, and suitably at least 0.12%. Nitrogen, however, at the same time impaires the hot workability of the alloy and shall therefore not exist more than in a maximum amount of 0.25%, preferably max 0.2%, and suitably max 0.18%. Moreover, there may exist traces of other elements, however, not more than as unavoidable amounts of impurities or as accessory elements from the melt metallurgical treatment of the alloy. Thus the steel may contain a certain amount of calcium and aluminum as a residual product from the finishing of the steel. Boron is an example of an element that shall be avoided, since that element even in very small amounts may impaire the oxidization resistance of the alloy by locating itself in the grain boundaries, where the existence of boron may prevent oxygen from penetrating and be deposited in the grain boundaries in a form of oxides.

BRIEF DESCRIPTION OF DRAWINGS

In the following description of the results, reference will be made to the attached drawings, in which.

OXIDIZATION EXPERIMENTS

In Table 2, alloys 1-7 are examples of the invention. Alloys A, B and C are commercial reference alloys. Alloy 1 was manufactured as a 500 kg test charge. Alloys 2-6 were manufactured as 13 kg laboratory charges. Alloy 7 was manufactured as a 10 ton full scale charge. As far as alloys 1-6 are concerned, the molten alloy was analysed prior to casting as well as the composition of the finished product. The impurity contents in all the examples were low. The balance therefore consisted essentially only of iron. The compositions of alloys A, B and C were obtained from the specifications for these materials.

TABLE 2

| Alloy No | Charge product | C | Si | Mn | Cr | Ni | Ce | N | Remarks |
|---|---|---|---|---|---|---|---|---|---|
| 1 | 052875 | 0.058 | 1.27 | 1.58 | 25.1 | 34.7 | 0.05 | 0.033 | |
| | plate | 0.054 | 1.19 | 1.59 | " | " | " | 0.032 | |
| 2 | B322 | 0.045 | 1.75 | 1.68 | 24.7 | 34.7 | 0.065 | 0.126 | |
| | bar | " | " | 1.67 | 25.0 | 34.9 | 0.03 | 0.121 | |
| 3 | B325 | 0.049 | 1.56 | 1.55 | 25.0 | 34.8 | 0.086 | 0.55 | |
| | bar | " | 1.54 | 1.53 | " | " | 0.034 | 0.56 | |
| 4 | B323 | 0.047 | 1.55 | 1.43 | 24.7 | 34.8 | 0.053 | 0.146 | |
| | bar | " | 1.52 | 1.42 | " | 34.9 | 0.018 | 0.147 | |
| 5 | B321 | 0.047 | 1.78 | 1.67 | 24.7 | 34.7 | 0.059 | 0.077 | |
| | bar | 0.046 | 1.75 | 1.66 | 25.0 | 34.9 | 0.023 | 0.078 | |
| 6 | B320 | 0.040 | 1.87 | 1.80 | 24.9 | 35.3 | 0.114 | not analysed | |
| | bar | " | 1.83 | 1.78 | " | " | 0.034 | 0.022 | |
| 7 | 2281-71 | 0.048 | 1.52 | 1.74 | 25.75 | 34.6 | 0.045 | 0.130 | |
| | plate | | | | | | | | |
| A | | max 0.08 | max 1.5 | max 2.0 | 24-26 | 19-22 | | | |
| B | | 0.04 | 0.35 | 0.75 | 21 | 31 | | | 0.3 Cu |
| C | | max 0.10 | 1.5-2.3 | 0.5 | 21 | 11 | 0.05 | 0.15 | |

Figure 1:
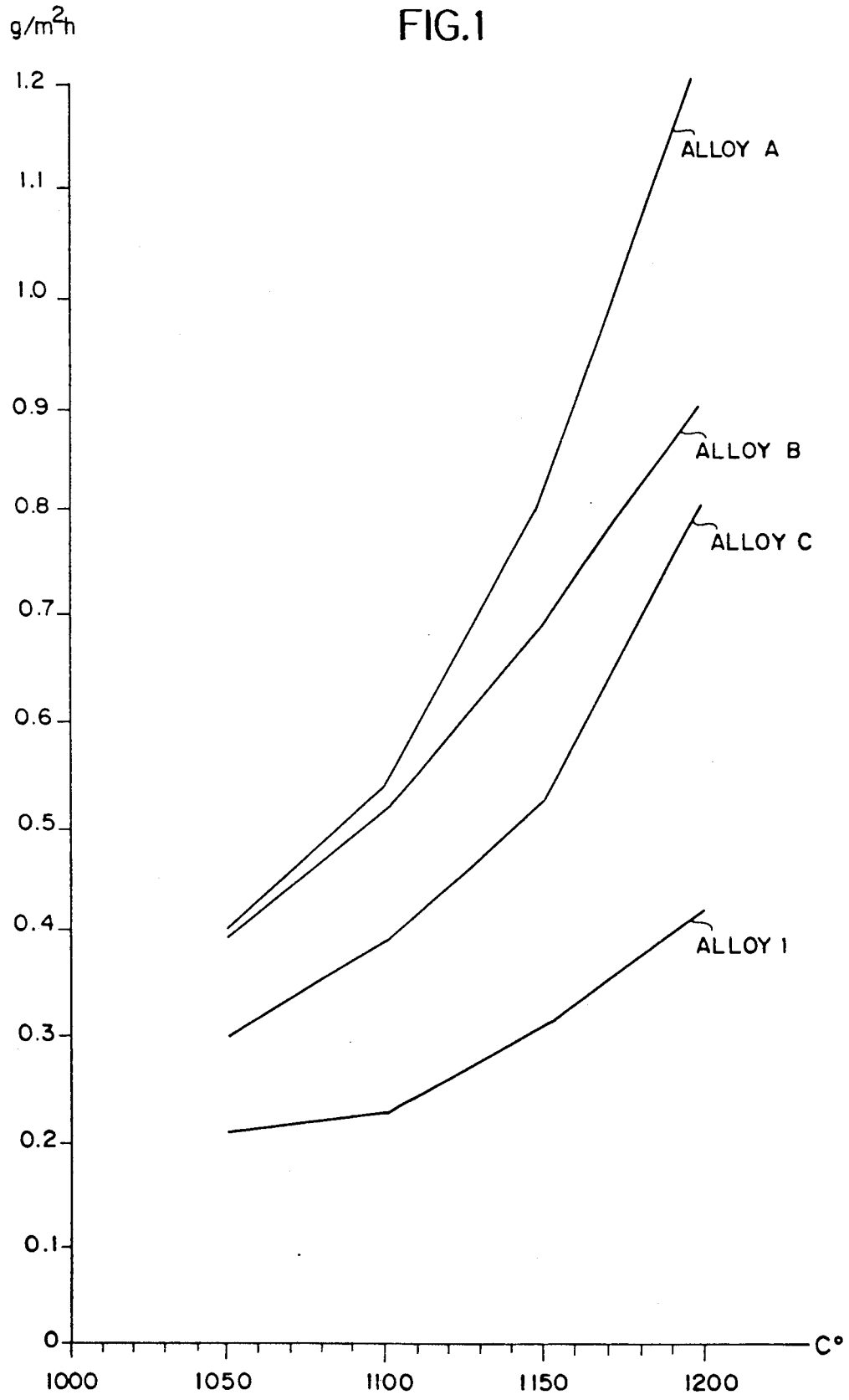
FIG. 1 is a graph in which the results after intermittent oxidization annealing of a number of commercial alloys are compared with the results from a first example of an alloy according to the invention.

The oxidization resistance of alloy No 1 was examined through oxidization annealing. Test coupons 25×15×2 mm were taken out from the plate. The coupons were planed and ground. The test coupons were oxidization annealed during a total annealing time=45 h and with five alternations down to room temperatures. The test coupons were annealed at varying temperatures between 1050° and 1200° C. The coupons were weighed by means of a standard balance prior and after the annealing experiments. The results are shown in FIG. 1 which also includes the results from corresponding testing of the commercial alloys A, B and C. From these results it can be stated that the scaling temperature may be 1200° C.

Thereafter also the full scale produced alloy No. 7 was oxidization tested in a thermo-balance. The increase of weight was measured as a function of the annealing temperature as in the proceeding experiment but all the way up to 1300° C. The coupons were weighed with a standard balance prior and after the annealing experiments as a complement to the thermo-balance measurements.

The thermo-balance value and the differences between the coupon prior and after the experiment for each individual sample is shown in Table 3.

Figure 2:
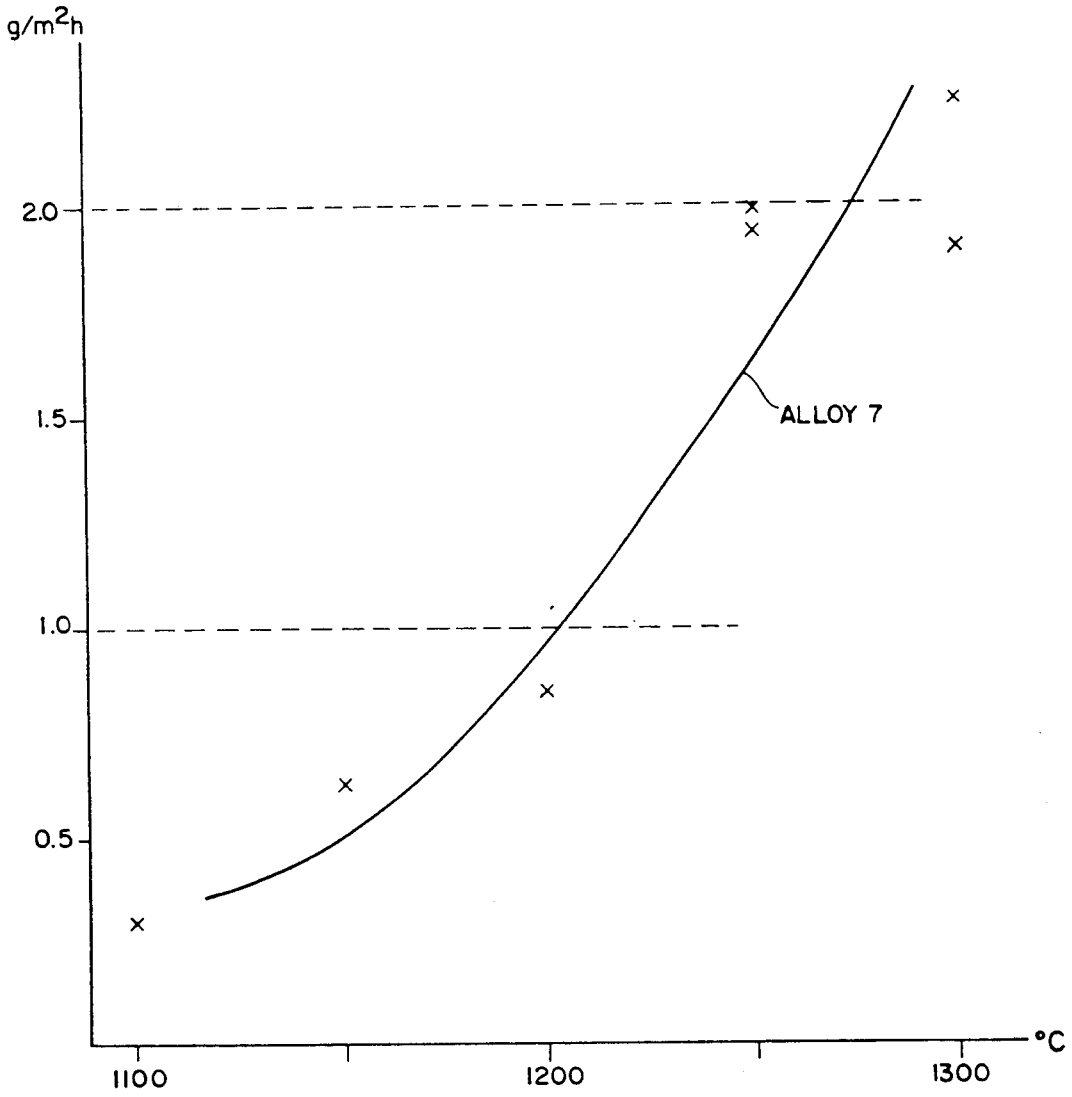
FIG. 2 is a graph which illustrates the oxidization resistance of an alloy according to a second example of the invention by showing the increase of weight in a thermo-balance as a function of the annealing temperature up to 1300° C.

The increase of weight in the thermo-balance as a function of the annealing temperature is shown in the graph in FIG. 2. The limits 1.0 and 2.0 gr/(m²h) has been indicated by a dashed line in FIG. 2 from the reason that the scaling temperature is defined by the size of the increase of weight in the following way: "The scaling must not exceed 1 g/(m²h) with the additional condition that 50° C. higher temperature must not give more than at the most 2 g/(m²h).

The result from the testing of alloy No. 7 shows that the alloy of the invention resists also a scaling temperature above 1200° C.

TABLE 3

Table over each individual sample of alloy No. 7, 17.7 mm plate, charge 2282-71. Intermittent annealing: five alternations during 45 h.

| Test temperature C | Experiment No | T-balance values g/m² | Loss of weight g/m² | Total take up of $O_2$ g/m² |
|---|---|---|---|---|
| 1100 | B451 | 7.43 | 6.64 | 14.08 |
| 1150 | B452 | 7.80 | 21.24 | 29.04 |
| 1200 | B453 | 11.87 | 23.08 | 34.95 |
| 1200 | B454 | 18.65 | 19.56 | 38.21 |
| 1250 | B455 | 54.19 | 32.09 | 86.28 |
| 1250 | B458 | 61.94 | 27.15 | 89.09 |
| 1300 | B456 | 35.95 | 47.90 | 83.85 |
| 1300 | B457 | 56.57 | 42.22 | 98.79 |

CREEP FRACTURE STRENGTH EXPERIMENTS

In these experiments the same alloys were used as in the oxidization experiments, Table 2.

The creep fracture strength of a 20 mm plate made of alloy No. 1 from a 500 kg test charge was examined at the temperatures 600°, 750° and 900° C. Table 4 shows obtained $R_{km}$-values and (within brackets) reference data including min/max-data from three full scale charges of the commercial steel grade C, Table 2. The examined test material with the low nitrogen content as expected has lower values than alloy C, which is known to have an extremely high creep fracture strength.

TABLE 4

| Temp °C. | Creep fracture limit, $R_{km}$, N/mm² | | | |
|---|---|---|---|---|
| | $10^2$h | $10^3$h | $10^4$h | $10^5$h* |
| 600 | 250 | 175 | 105 | 62 |
| | (300-315) | (235-240) | (145-155) | (≈88-≈100) |
| 750 | 78 | 45 | 24 | 13 |
| | (105-125) | (67-73) | (38-42) | (≈21-≈24) |

TABLE 4-continued

| Temp °C | Creep fracture limit, $R_{km}$, N/mm² | | | |
|---|---|---|---|---|
| | $10^2$h | $10^3$h | $10^4$h | $10^5$h* |
| 900 | 28 | 16 | 10 | 5 |
| | (36-40) | (23) | (14-16) | (≈8-≈12) |

*The values for $10^5$h have been derived through manual (graphical) extrapolation about one 10-power of time The five 13 kg laboratory charges, alloys 2-6, were manufactured in order to examine the impact of the nitrogen content upon the creep fracture strength of the alloy according to the invention. The ingots from these small laboratory charges were forged to size ϕ 20 mm. The nitrogen contents varied from min. 0.022% to max. 0.147%. The measured creep fracture limit values at 900° C. are shown in Table 5.

TABLE 5

| Charge | N % | Ce % | Creep fracture limit, $R_{km}$, N/mm² | | |
|---|---|---|---|---|---|
| | | | $R_{km}$/100 h | $R_{km}$/1000 h | $R_{km}$/10 000 h* |
| B 322 | 0.121 | 0.030 | 33 | 20 | (12) |
| B 325 | 0.056 | 0.034 | 31 | 19 | (11) |
| B 323 | 0.147 | 0.018 | 34 | 18 | (10) |
| B 321 | 0.078 | 0.023 | 33 | 17 | (9) |
| B 320 | 0.022 | 0.034 | 28 | 16 | (9) |

*The values for $10^4$h have been derived through manual (graphical) extrapolation about one 10-power of time.

In the continued experiments concerning the influence of the content of nitrogen, the best result was achieved with alloy No. 2 containing 0.12% N. The improvement as far as the value of the creep fracture limit at 900° C. is concerned was about 20%. The experiments also show that also the content of cerium appears to have an impact upon the creep fracture strength. The comparatively low values for alloy No. 4 —in spite of a nitrogen content of about 0.15%—therefore may depend on the fact that according to the control analyse the content of cerium was only 0.018%. This also indicates the importance of protecting the lanthanides during the manufacturing so that these elementes are not lost in connection with the finishing of the melt and the subsequent casting. Also the rod material of alloy No. 5, which contained about 0.08% nitrogen and 0.023% cerium, seems to get a larger reduction of the creep fracture values when the testing period is prolonged, probably depending on the moderate content of cerium, which indicates that the content of cerium should be at least 0.03% in order to bring about an effect not only upon the oxidization resistance but also upon the creep fracture strength. The investigation moreover shows that the creep fracture strength is significantly increased with increased nitrogen content.

CARBURIZATION EXPERIMENTS

These experiments concern studies if six different alloys in a reducing, carburizing atmosphere. The depths of carburization were measured and from these measurements the carburization rates were evaluated. The chemical compositions in weight-% are shown in Table 6. The compositions of alloys D-H relate to analysed compositions, while the composition of alloy I is the nominal composition. Alloys D, E, G and H are commercial, austenitic steels. Alloy F has a composition according to the invention, and alloy I is a commercial, well-known nickel base alloy.

TABLE 6

| | Chemical composition, weight-% | | | | | | | | | |
|---|---|---|---|---|---|---|---|---|---|---|
| Alloy | Fe | Ni | Cr | C | Si | N | Mo | Mn | Other elements | Ni/Fe-ratio |
| D | 69.6 | 9.6 | 18.4 | .06 | 1.3 | .15 | .26 | .53 | .04Ce | .14 |
| E | 65.5 | 10.9 | 20.8 | .09 | 1.7 | .16 | .24 | .59 | .04Ce | .17 |
| F | 36.1 | 34.6 | 25.8 | .05 | 1.5 | .13 | .05 | 1.74 | .05Ce | .96 |
| G | 53.8 | 19.1 | 24.7 | .05 | .5 | .07 | .25 | 1.50 | — | .36 |
| H | 62.7 | 12.6 | 22.2 | .06 | .39 | .10 | .37 | 1.51 | — | .20 |
| I | 15.5 | 60 | 23 | | | | | | 1.5Al | 3.87 |

The materials in all these cases had the shape of plates, and from these plates coupons were taken, size 10×10×1-2 mm. The coupons were ground and carefully cleaned, whereafter they were subjected to a reducing, carburizing atmosphere at the temperatures 850° C., 950° C., 1050° C. and 1150° C. during a period of exposure which lasted from 20 min to 25 h. The reaction gases consisted of 89% $H_2$ and 11% $C_3H_6$, which was flushed through the furnace at a flow rate of 160 m/min.

The carburization of the studied samples was analysed metallographically, and the carburization kinetics was found to be parabolic and could be described by the equation $x^2=2k_pt$, where x = the depths of penetration, $k_p$ = a rate constant and t = time of exposure. The obtained data was plotted according to this equation, and the graphical relations then could be used to estimate the $k_p$-values, which are listed in Table 7 and 8.

It was found through metallurgical studies that the carburization region could be devided into two zones. First is the so-called massive carburization zone which is a zone just beneath the alloy surface. At greater depths there is a second zone of caride precipitates along the grain boundaries. The carburization rate constants, $k_p$, are shown in Table 7 for total, i.e. massive plus intergranular carbide formation, and in Table 8 for massive carburization in the surface zone only.

TABLE 7

| Values of carburization rate constants, $k_p$ ($10^3$ $\mu m^2/h$) for total carburization depths | | | | | | |
|---|---|---|---|---|---|---|
| Temp | Alloy | | | | | |
| °C | D | E | F | G | H | I |
| 850 | 5.9 | 1.4 | — | 3.0 | 4.0 | — |
| 950 | 12.0 | 2.8 | .1 | 3.8 | 8.4 | .6 |
| 1050 | 43.1 | 48.3 | 10.8 | 27.5 | 38.8 | * |
| 1150 | — | 195.7 | 54.1 | 196.8 | — | * |

*samples completely carburized

TABLE 8

| Values of carburization rate constants, $k_p$ ($10^3$ $\mu m^2/h$) for massive carburization. | | | | | | |
|---|---|---|---|---|---|---|
| Temp | Alloy | | | | | |
| °C | D | E | F | G | H | I |
| 850 | 1.4 | .05 | — | .8 | 2.0 | — |
| 950 | 4.3 | — | .3 | 4.4 | 7.0 | 1.7 |
| 1050 | — | 14.7 | 8.4 | 9.0 | 15.8 | 9.4 |
| 1150 | — | 38.4 | 11.0 | 19.5 | — | 31.2 |

Table 7 and 8 show that alloy F of the invention had the significantly lowest $k_p$-value as far as concerns massive carburization as well as total carburization.

I claim:

1. An iron-, nickel-, chromium base alloy having an austenitic structure, good high temperature features, including a very high resistance oxidization in an oxidizing atmosphere and to carburization in a carburizing atmosphere at high temperatures, and a high creep fracture resistance, said alloy consisting essentially of the following composition in weight %:

| | |
|---|---|
| 0.01-0.08 | C |
| 1.2-2.0 | Si |
| from traces up to 2 | Mn |
| 22-29 | Cr |
| 32-38 | Ni |
| 0.01-0.15 | rare earth metals |
| 0.08-0.25 | N |

balance essentially only iron and unavoidable impurities and normally occurring accessory elements in normal amounts, said rare earth metals in combination with the said content of silicon improving the growth of a protecting $SiO_2$-layer on the metal surface, when the metal surface is subjected to high temperatures in an oxidizing atmosphere, which counteracts transportation of metal ions out of the alloy, so that scaling is minimized.

2. An alloy according to claim 1, wherein the carbon content of between 0.02 and 0.08%.

3. An alloy according to claim 2, wherein the carbon content is at least 0.035 and not more than 0.065%.

4. An alloy according to claim 1, wherein the silicon content is at least 1.3 and not more than 1.8%.

5. An alloy according to claim 2, wherein the nitrogen content of between 0.1 and 0.2%.

6. An alloy according to claim 5, wherein the nitrogen content is at least 0.12 and not more than 0.18%.

7. An alloy according to claim 1, wherein the rare earth metals content is at least 0.02%.

8. An alloy according to claim 7, wherein the rare earth metals content is at least 0.03%.

9. An alloy according to claim 7, wherein the content of cerium is max 0.1%.

10. An alloy according to claim 1, wherein the chromium content is between 23 and 27%.

11. An alloy according to claim 1, wherein the nickel content is between 33 and 37%.

12. An alloy according to claim 1, wherein the manganese content is between 1.3 and 1.8%.

* * * * *